US009526952B1

(12) United States Patent
Dacey et al.

(10) Patent No.: US 9,526,952 B1
(45) **Date of Patent: *Dec. 27, 2016**

(54) PUTTER-TYPE GOLF CLUB HEAD WITH SOUND CHAMBER

(71) Applicant: Callaway Golf Company, Carlsbad, CA (US)

(72) Inventors: Kevin Dacey, Carlsbad, CA (US); Craig E. Abbott, Vista, CA (US); Augustin W. Rollinson, Carlsbad, CA (US); Brandon D. DeMille, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 78 days.

This patent is subject to a terminal disclaimer.

(21) Appl. No.: 14/662,400

(22) Filed: Mar. 19, 2015

(51) Int. Cl.
*A63B 53/04* (2015.01)
*A63B 53/00* (2015.01)

(52) U.S. Cl.
CPC ..... *A63B 53/007* (2013.01)

(58) Field of Classification Search
CPC ..... A63B 53/007; A63B 2053/0416; A63B 53/0487; A63B 69/3635; A63B 53/065; A63B 2053/0412; A63B 2053/042
USPC ..... 473/324–350, 287–292, 219–256
See application file for complete search history.

(56) References Cited

U.S. PATENT DOCUMENTS 4,067,572 A * 1/1978 Coleman ..... A63B 53/04 473/245
4,113,249 A * 9/1978 Beery ..... A63B 53/0487 473/329
4,735,414 A * 4/1988 Williams ..... A63B 53/065 473/248
4,872,683 A * 10/1989 Doran ..... A63B 53/04 473/249
5,160,144 A * 11/1992 Maniatis ..... A63B 53/0487 473/234
5,322,285 A * 6/1994 Turner ..... A63B 53/007 473/313
5,346,219 A * 9/1994 Pehoski ..... A63B 53/0487 473/325
5,485,997 A * 1/1996 Schmidt ..... A63B 53/04 473/251
5,551,694 A * 9/1996 Grim, Jr. ..... A63B 53/0487 473/234
5,913,731 A * 6/1999 Westerman ..... A63B 53/0487 473/251
6,688,989 B2 * 2/2004 Best ..... A63B 53/04 473/332
6,860,822 B2 * 3/2005 Vrska, Jr. ..... A63B 53/0487 473/324
7,086,961 B2 * 8/2006 Wright ..... A63B 53/0487 473/329
7,309,291 B1 * 12/2007 Bryant ..... A63B 53/0487 273/DIG. 14

(Continued)

*Primary Examiner* — Sebastiano Passaniti

(74) *Attorney, Agent, or Firm* — Michael A. Catania; Rebecca Hanovice; Sonia Lari

(57) ABSTRACT

A putter-type golf club head with a sound chamber is disclosed herein. The club head comprises a body and a face insert over the sound chamber. The sound chamber comprises a central sound sub-chamber and an outer sound sub-chamber. The body, the sound chamber and the face insert amplify the sound generated by the putter-type golf club head striking a golf ball.

19 Claims, 9 Drawing Sheets

(56) References Cited

U.S. PATENT DOCUMENTS

| | | | | |
|---|---|---|---|---|
| 7,354,355 | B2 * | 4/2008 | Tavares | A63B 53/04 473/329 |
| 8,070,623 | B2 * | 12/2011 | Stites | A63B 53/0466 473/329 |
| 8,684,860 | B2 * | 4/2014 | Rollinson | A63B 53/007 473/329 |
| 8,840,489 | B2 * | 9/2014 | Del Rosario | A63B 53/0487 473/329 |
| 8,915,798 | B2 * | 12/2014 | Hocknell | A63B 53/04 473/329 |
| 2004/0092327 | A1 * | 5/2004 | Marnocha | A63B 69/3614 473/220 |
| 2008/0234066 | A1 * | 9/2008 | Jones | A63B 53/0487 473/342 |

* cited by examiner

PUTTER-TYPE GOLF CLUB HEAD WITH SOUND CHAMBER

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a putter-type golf club head. More specifically, the present invention relates to a putter-type golf club head with a sound chamber to effect the sound when the putter-type golf club head strikes a golf ball.

Description of the Related Art

The prior art discloses various golf club heads that have been modified to influence the sound of club head impacting a golf ball.

Beery, U.S. Pat. No. 4,113,249, for a Golf Club And Manufacture Thereof discloses a golf club head with a sound chamber and a plastic insert covering the sound chamber in order to minimize dampening of sound frequencies.

Maniatis, U.S. Pat. No. 5,160,144, for a Golf Putter Including Tuning Fork Effects, discloses a putter head with a vertical slice to create a tuning fork effect.

Turner, U.S. Pat. No. 5,322,285, for a Golf Putter, discloses a putter with a low frequency (below 2500 Hz) sound.

Pehoski et al., U.S. Pat. No. 5,346,219, for a Golf Putter Head, discloses a putter head that generates a ringing sound when a golf ball is struck.

Grim, Jr. et al., U.S. Pat. No. 5,551,694, for a Sounding Golf Putter, discloses a putter head with sound producing tines.

Wright et al., U.S. Pat. No. 7,086,961, for a Method And Apparatus For Using A Frequency Selectable Insert In A Golf Club Head, discloses an insert composed of a plate, a dampener and a mass.

Tavares et al., U.S. Pat. No. 7,354,355, for a Golf Club Head Or Other Ball Striking Device With Modifiable Feel Characteristics, discloses a putter head with openings in which elements are placed to change the feel and sound of the putter head.

However, there is still a need for a putter with a better sound.

BRIEF SUMMARY OF THE INVENTION

The present invention is a putter with a better sound when impacting a golf ball.

One aspect of the present invention is a putter-type golf club head with a sound chamber. The club head comprises a body and a face insert over the sound chamber. The body comprises a heel end, a toe end, an aft end, a face portion, a crown portion and a sole portion. The body defines the sound chamber, which has an opening in the face portion. The sound chamber comprises a central sound sub-chamber and an outer sound sub-chamber. The face insert is positioned over the opening. The body, the sound chamber and the face insert amplify the sound generated by the putter-type golf club head striking a golf ball.

Another aspect of the present invention is a putter-type golf club head with a sound chamber and a variable thickness face insert. The club head comprises a body and a face insert over the sound chamber. The body defines the sound chamber, which has an opening in a face portion. The face insert is positioned over the opening. An internal surface of the face insert has a cross-bar pattern with a thick cross bar and four thin sections. A thickness of the cross bar is at least 0.03 inch greater than a thickness of each of the thin sections. The body, the sound chamber and the face insert amplify the sound generated by the putter-type golf club head striking a golf ball.

Yet another aspect of the present invention is a putter-type golf club head with a sound chamber and a different variable thickness face insert. The club head comprises a body and a face insert over the sound chamber. The body defines the sound chamber, which has an opening in a face portion. The face insert is positioned over the opening. An internal surface of the face insert has a central section and two thin sections on each side of the central section. A thickness of the central section is at least 0.03 inch greater than a thickness of each of the thin sections. The body, the sound chamber and the face insert amplify the sound generated by the putter-type golf club head striking a golf ball.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
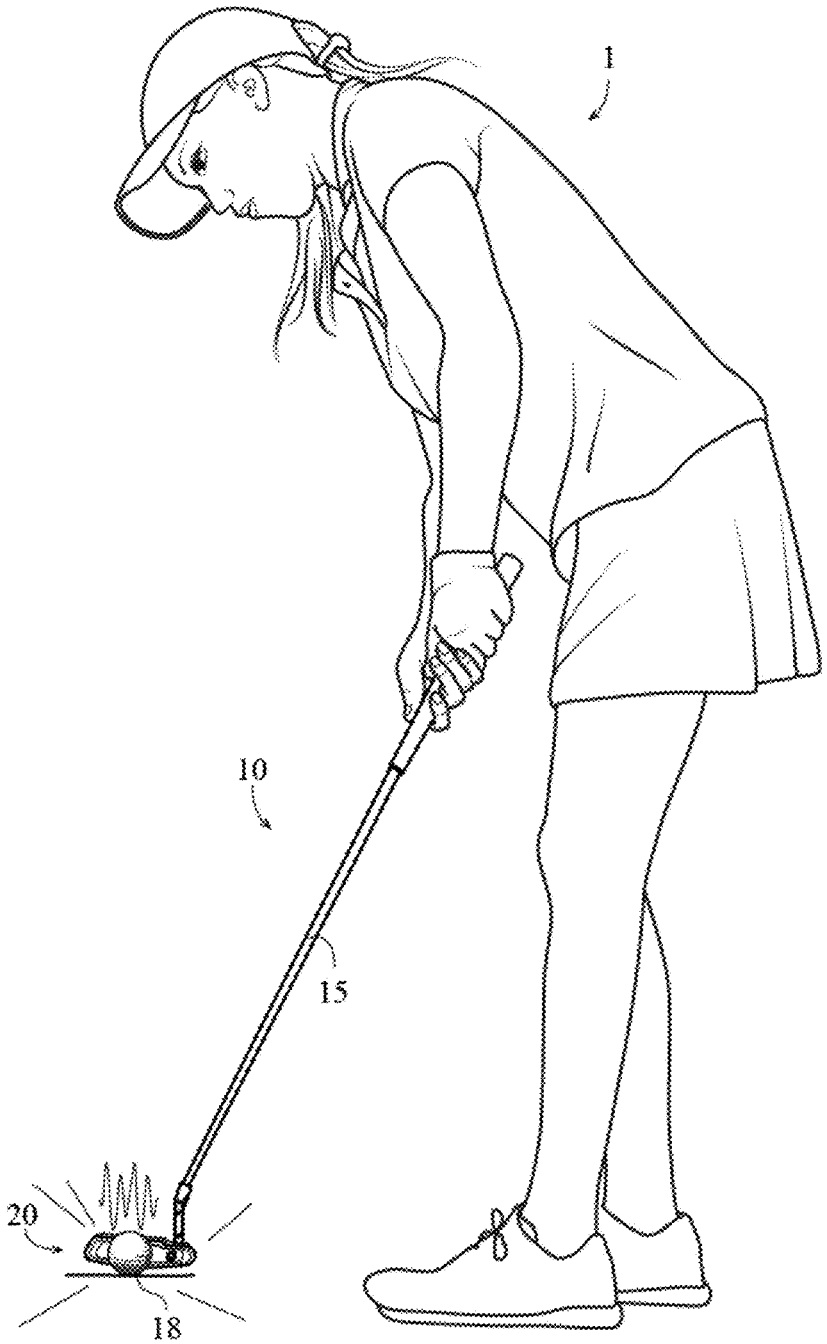
FIG. 1 is an illustration of a golfer striking a golf ball with a putter having a putter-type golf club head with a sound chamber.

As shown in FIG. 1, a golfer 1 strikes a golf ball 18 with a putter 10 having a shaft 15 and club head 20. The impact generates a sound, which is heard by the golfer. The putter-type club head 20 with a sound chamber amplifies the sound.

Figure 2A:
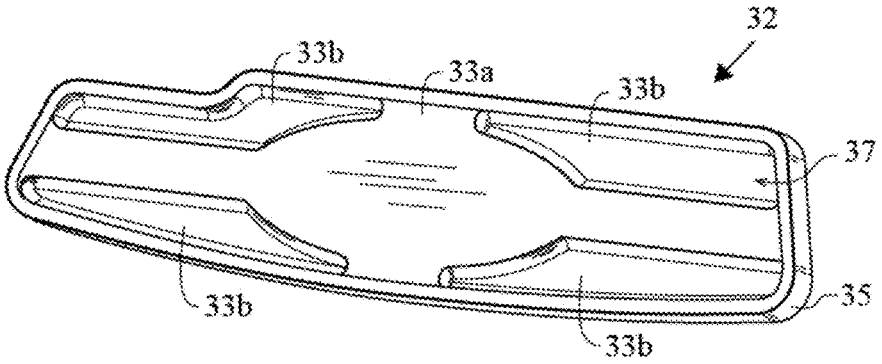
FIG. 2A is an isolated top perspective view of a preferred embodiment of a face insert for a putter-type golf club head.

As shown in FIG. 2A, a first embodiment of a face insert 32 has an internal surface with a cross bar pattern having a cross bar thick section 33*a* and four thin sections 33*b*. The cross bar thick section 33*a* preferably has a thickness ranging from 0.05 inch to 0.11 inch, and most preferably has a thickness of 0.09 inch. Each of the thin sections 33*b* preferably has a thickness ranging from 0.02 inch to 0.075 inch, and most preferably has a thickness of 0.05 inch. The thickness of the cross bar thick section 33*a* is at least 0.03 inch greater than a thickness of each of the thin sections 33*b*. The face insert 32 preferably has a return portion 35 and a striking plate portion 37. The return portion 35 preferably has a thickness ranging from 0.075 inch to 0.125 inch, and most preferably a thickness of 0.10 inch. The cross bar thick section 33*a* and four thin sections 33*b* are part of the striking plate portion 37. The face insert is preferably composed of a metal material such as an aluminum alloy, an iron alloy, a titanium alloy, tin, bronze, and the like.

Figure 2B:
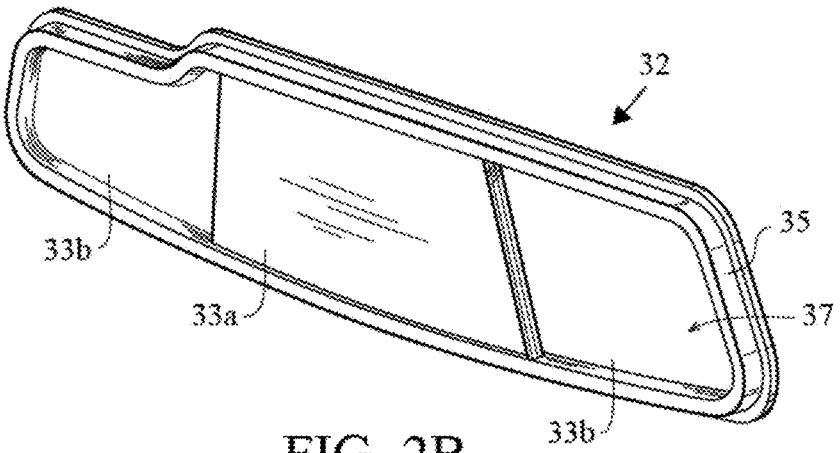
FIG. 2B is an isolated top perspective view of an alternative embodiment of a face insert for a putter-type golf club head.

As shown in FIG. 2B, a second embodiment of a face insert 32 has an internal surface with a thick central section 33*a* and two thin side sections 33*b*. The thick central section 33*a* preferably has a thickness ranging from 0.05 inch to 0.11 inch, and most preferably has a thickness of 0.09 inch. Each of the thin sections 33*b* preferably has a thickness ranging from 0.02 inch to 0.075 inch, and most preferably has a thickness of 0.05 inch. The thickness of the thick central section 33*a* is at least 0.03 inch greater than a thickness of each of the thin sections 33*b*. The face insert 32 preferably has a return portion 35 and a striking plate portion 37. The return portion 35 preferably has a thickness ranging from 0.075 inch to 0.125 inch, and most preferably a thickness of 0.10 inch. The cross bar thick section 33*a* and four thin sections 33*b* are part of the striking plate portion 37. The face insert is preferably composed of a metal material such as an aluminum alloy, an iron alloy, a titanium alloy, tin, bronze, and the like.

Those skilled in the pertinent art will recognize that other face inserts may be utilized with the putter-type club head having a sound chamber without departing from the scope and spirit of the invention. An example of such an insert is disclosed in Hocknell et al, U.S. Pat. No. 8,915,798, for a Putter Face Insert, which is hereby incorporated by reference in its entirety. Another example of such an insert is disclosed in Del Rosario et al, U.S. Pat. No. 8,840,489, for a Putter Face Insert, which is hereby incorporated by reference in its entirety. Yet another example of such an insert is disclosed in Rollinson, U.S. Pat. No. 8,684,860, for a Putter Face Insert, which is hereby incorporated by reference in its entirety.

Figure 3:
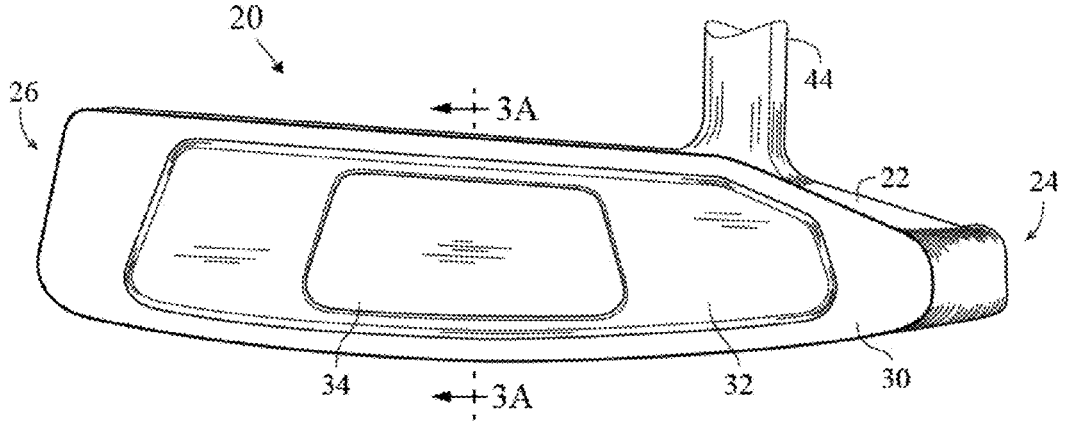
FIG. 3 is a front elevation view of a putter-type golf club head with a sound chamber.
Figure 3A:
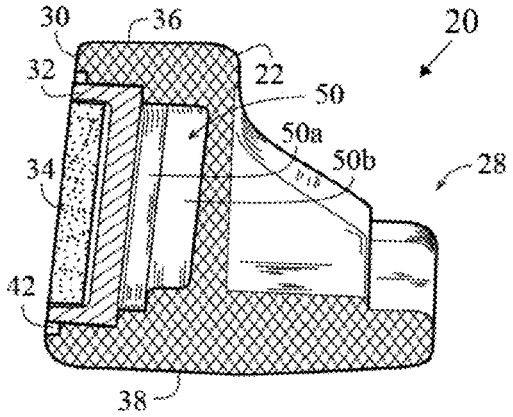
FIG. 3A is a cross-sectional view of a putter-type golf club head with a sound chamber along line A-A of FIG. 3.

As shown in FIGS. 3 and 3A, a putter-type club head 20 comprises a body 22 and a face insert 32 over a sound chamber 50. The body 22 comprises a heel end 24, a toe end 26, an aft end 28, a face portion 30, a crown portion 36 and a sole portion 38. The body 22 defines the sound chamber 50, which has an opening 42 in the face portion 30. The sound chamber 50 comprises a central sound sub-chamber 50*b* and an outer sound sub-chamber 50*a*. In this embodiment, the central sound sub-chamber 50*b* has a larger volume than the outer sound sub-chamber 50*a*. The face insert 32 is positioned over the opening 42. In this embodiment, the face insert has an inner insert 34.

The body 22 preferably has a volume ranging from 2.3 cubic inches to 2.8 cubic inches, and most preferably has a volume of 2.52 cubic inches. The sound chamber 50 preferably has a volume ranging from 0.25 cubic inch to 0.95 cubic inch, and most preferably 0.41 cubic inch.

The putter-type golf club head 20 preferably has a pitch ranging from 2400 Hertz (Hz) to 2700 Hz. The putter-type golf club head 20 preferably has an amplitude ranging from 61.5 to 64.5 dBA (A weighted decibels, dBA, are an expression of the relative loudness of sounds in air as perceived by the human ear). The putter-type golf club head 20 preferably has a duration ranging from 25 milliseconds to 45 milliseconds.

A back wall thickness of the sound chamber 50 preferably ranges from 0.045 inch to 0.070 inch, and more preferably from 0.055 inch to 0.060 inch, and most preferably is 0.058 inch. The backwall of the sound chamber 50 extends from the rearmost point of the central sound sub-chamber 50*b* to the exterior surface of a rearwall of the body 22.

Figure 4:
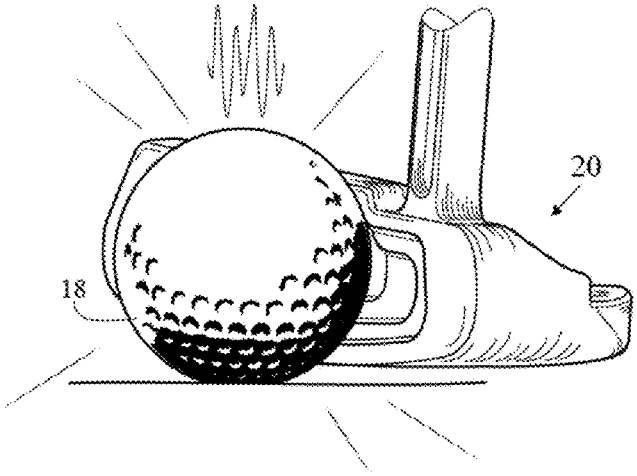
FIG. 4 is an illustration of a golf ball impacting a face of a putter-type golf club head having a sound chamber.

FIG. 4 illustrates a golf ball 18 impacting a face of a putter-type golf club head 20 having a sound chamber.

Figure 5:
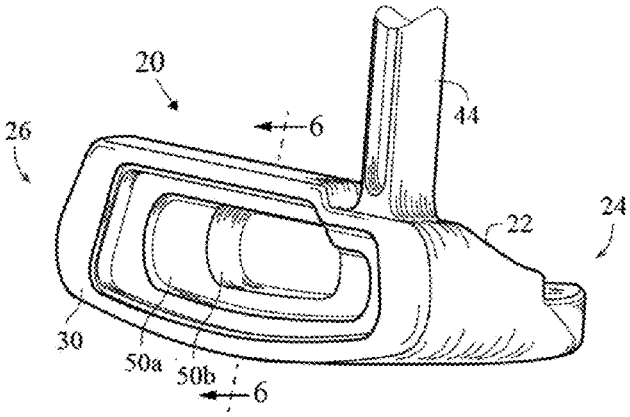
FIG. 5 is a front elevation view of a putter-type golf club head with a sound chamber with a face insert removed to illustrate the sound chamber.
Figure 6:
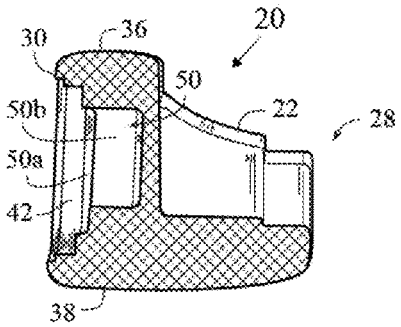
FIG. 6 is a cross-sectional view of a putter-type golf club head with a sound chamber.

FIGS. 5 and 6 illustrate an alternative embodiment of a putter-type golf club head 20 with a sound chamber 50. The body 22 comprises a heel end 24, a toe end 26, an aft end 28, an aft wall 29 with an aperture 52, a face portion 30, a crown portion 36 and a sole portion 38. A hosel 44 extends upward from a heel end 24 of the crown portion 36 of the body 22. The dampening screw 54 is threadingly positioned in the aperture 52. The body 22 defines the sound chamber 50, which has an opening 42 in the face portion 30. The sound chamber 50 comprises a central sound sub-chamber 50*b* and an outer sound sub-chamber 50*a*. In this embodiment, the central sound sub-chamber 50*b* has a larger volume than the outer sound sub-chamber 50*a*. The body 22 preferably has a volume ranging from 2.3 cubic inches to 2.8 cubic inches, and most preferably has a volume of 2.52 cubic inches. The sound chamber 50 preferably has a volume ranging from 0.25 cubic inch to 0.75 cubic inch, and most preferably 0.41 cubic inch. This embodiment of the putter-type golf club head 20 preferably has a pitch of 2550 Hz, an amplitude of 63 dBA and a duration of 30 milli-seconds.

Figure 7:
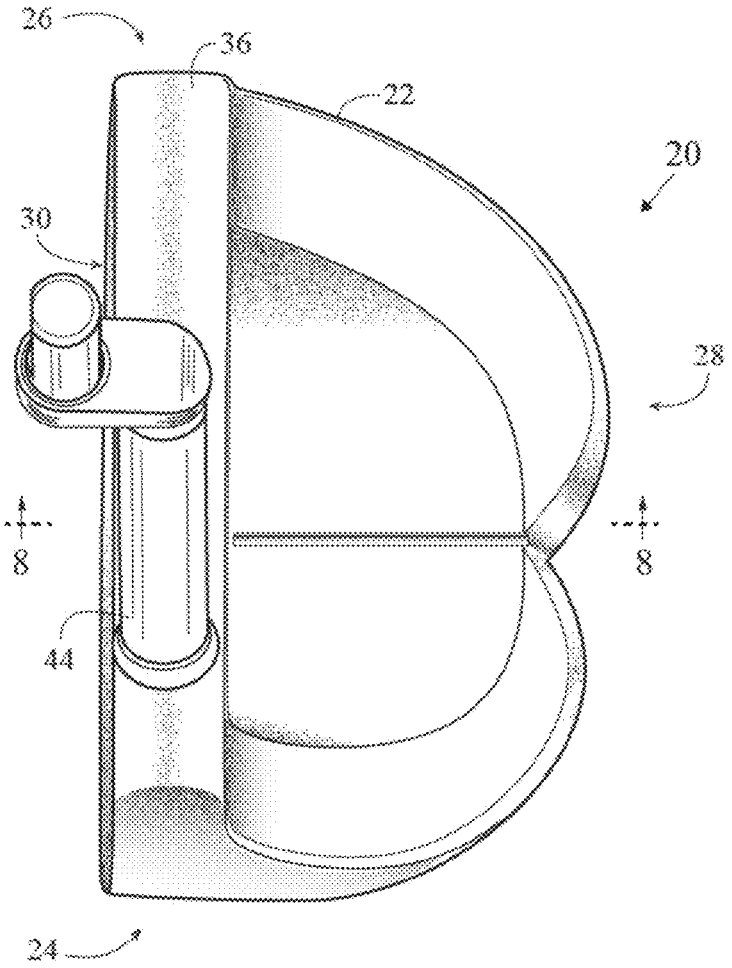
FIG. 7 is a top plan view of a putter-type golf club head with a sound chamber.
Figure 8:
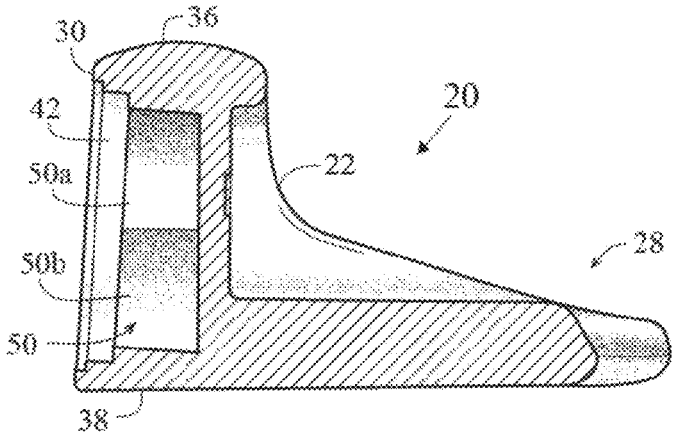
FIG. 8 is a cross-sectional view of a putter-type golf club head with a sound chamber along line 8-8 of FIG. 7.

FIGS. 7 and 8 illustrate an alternative embodiment of a putter-type golf club head 20 with a dampening screw 54. The dampening screw 54 preferably comprises a tip section 54*a* and a threaded section 54*b*. The tip section has an engagement surface 54*c* which engages the interior surface of the face insert 32 to dampen the sound when the putter strikes a golf ball. The body 22 comprises a heel end 24, a toe end 26, an aft end 28, an aft wall 29 with an aperture 52, a face portion 30, a crown portion 36 and a sole portion 38. A hosel 44 extends upward from a heel end 24 of the crown portion 36 of the body 22. The body 22 defines the sound chamber 50, which has an opening 42 in the face portion 30. The sound chamber 50 comprises a central sound sub-chamber 50*b* and an outer sound sub-chamber 50*a*. In this embodiment, the central sound sub-chamber 50*b* has a larger volume than the outer sound sub-chamber 50*a*. The body 22 preferably has a volume ranging from 2.3 cubic inches to 2.8 cubic inches, and most preferably has a volume of 2.42 cubic inches. The sound chamber 50 preferably has a volume ranging from 0.5 cubic inch to 0.95 cubic inch, and most preferably 0.84 cubic inch. This embodiment of the putter-type golf club head 20 preferably has a pitch of 2700 Hz, an amplitude of 64.5 dBA and a duration of 35 milli-seconds.

Figure 9:
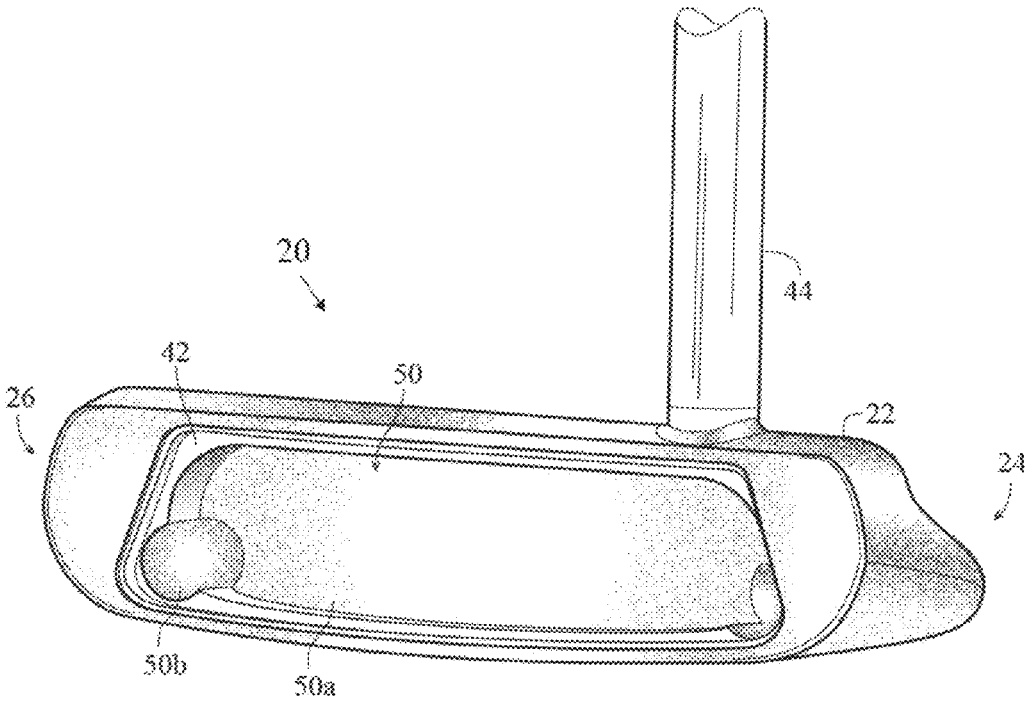
FIG. 9 is a front elevation view of an alternative embodiment putter-type golf club head with a sound chamber with a face insert removed to illustrate the sound chamber.
Figure 10:
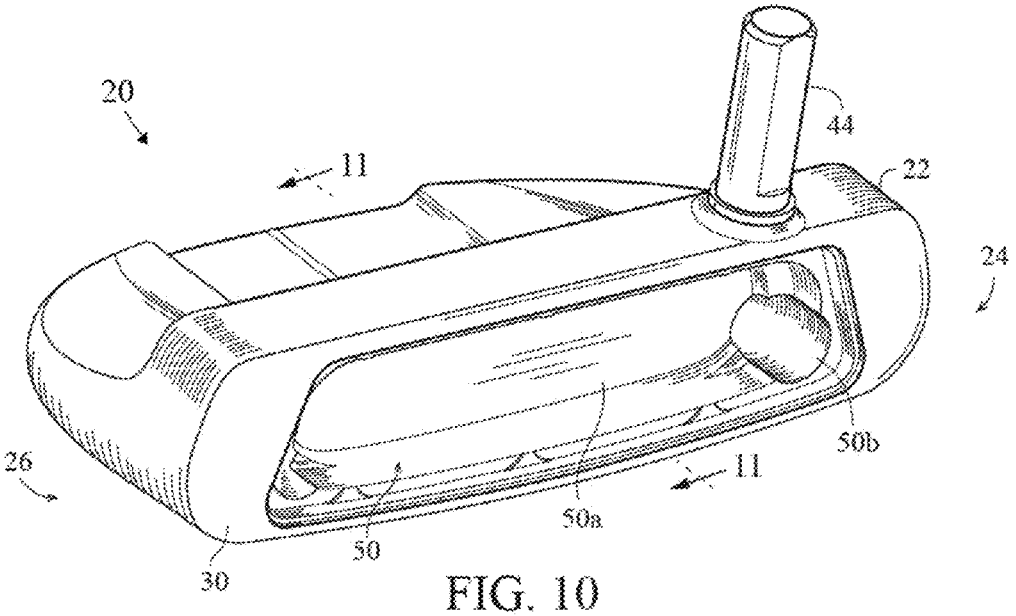
FIG. 10 is a top perspective view of an alternative embodiment putter-type golf club head with a sound chamber with a face insert removed to illustrate the sound chamber.
Figure 11:
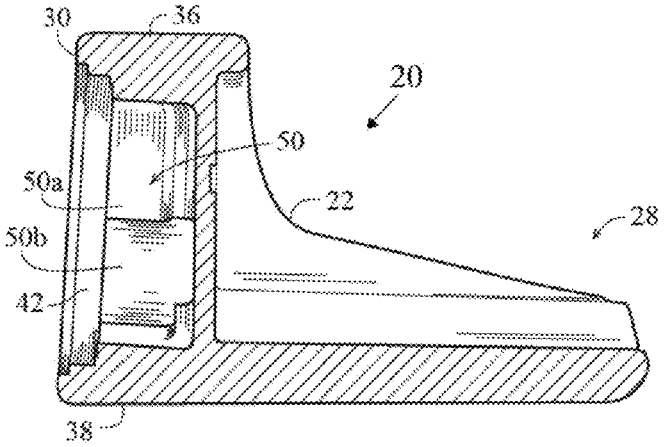
FIG. 11 is a cross-sectional view of a putter-type golf club head with a sound chamber along line 11-11 of FIG. 10.
Figure 12:
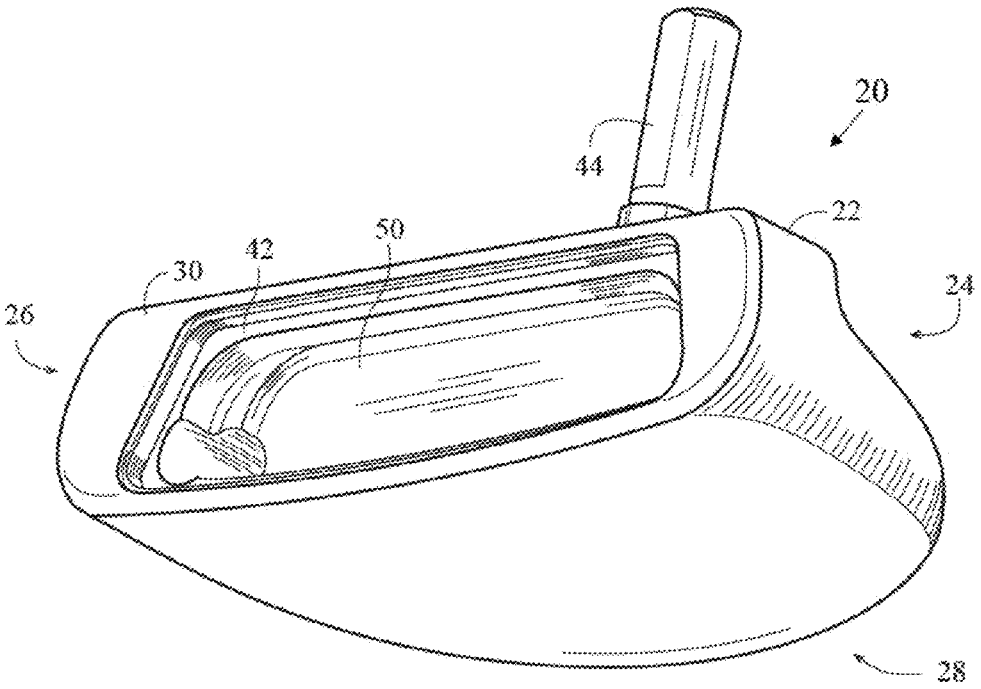
FIG. 12 is a bottom perspective view of an alternative embodiment putter-type golf club head with a sound chamber with a face insert removed to illustrate the sound chamber.
Figure 13:
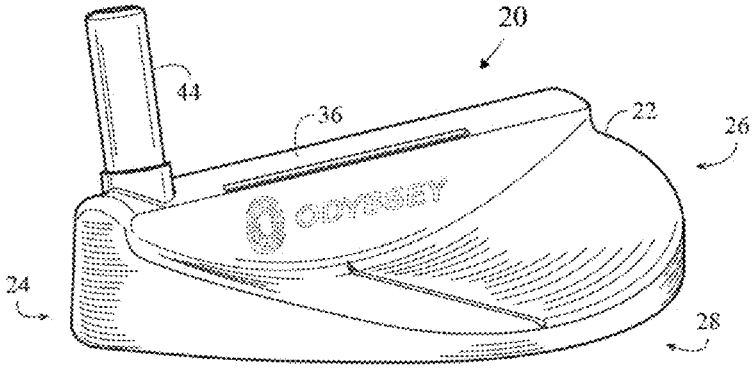
FIG. 13 is a rear view of an alternative embodiment putter-type golf club head with a sound chamber with a face insert removed to illustrate the sound chamber.
Figure 14:
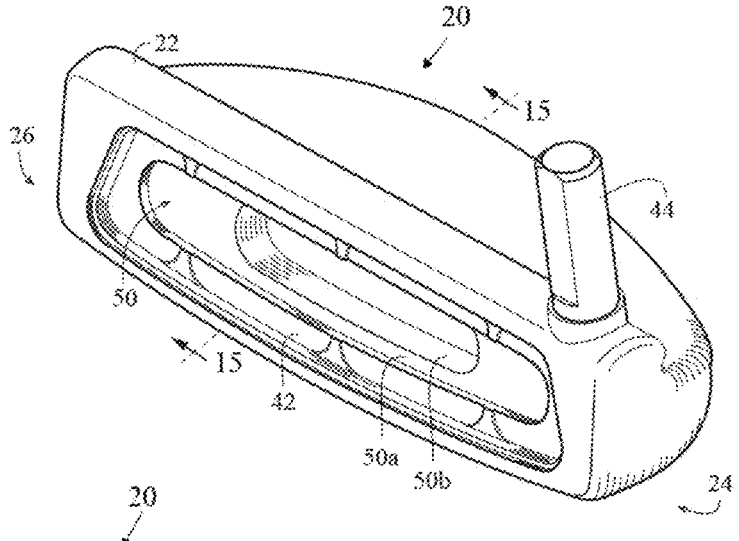
FIG. 14 is a top perspective view of an alternative embodiment putter-type golf club head with a sound chamber with a face insert removed to illustrate the sound chamber.
Figure 15:
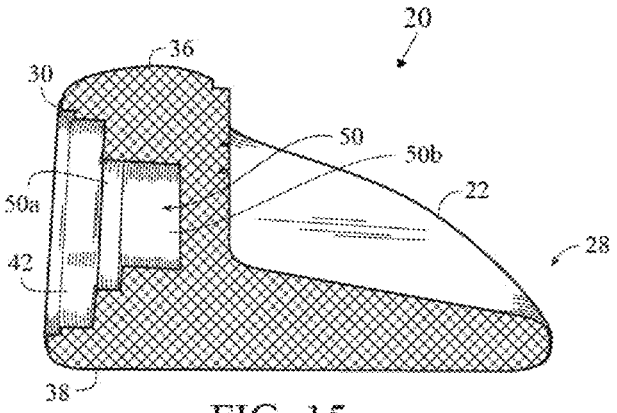
FIG. 15 is a cross-sectional view of a putter-type golf club head with a sound chamber along line 15-15 of FIG. 14.

FIG. 9 illustrates an alternative embodiment of a putter-type golf club head 20 with a dampening screw 54. The body 22 comprises a heel end 24, a toe end 26, an aft end 28, an aft wall 29 with an aperture 52, a face portion 30, a crown portion 36 and a sole portion 38. A hosel 44 extends upward from a heel end 24 of the crown portion 36 of the body 22. The body 22 defines the sound chamber 50, which has an opening 42 in the face portion 30. The sound chamber 50 comprises a central sound sub-chamber 50*b* and an outer sound sub-chamber 50*a*. In this embodiment, the central sound sub-chamber 50*b* has a larger volume than the outer sound sub-chamber 50*a*. The body 22 preferably has a volume ranging from 2.3 cubic inches to 2.8 cubic inches, and most preferably has a volume of 2.41 cubic inches. The sound chamber 50 preferably has a volume ranging from 0.5 cubic inch to 0.95 cubic inch, and most preferably 0.81 cubic inch. This embodiment of the putter-type golf club head 20 preferably has a pitch of 2600 Hz, an amplitude of 62.5 dBA and a duration of 25 milli-seconds.

FIGS. 12-15 illustrate an alternative embodiment of a putter-type golf club head 20 with a sound chamber 50. The body 22 comprises a heel end 24, a toe end 26, an aft end 28, a face portion 30, a crown portion 36 and a sole portion 38. A hosel 44 extends upward from a heel end 24 of the crown portion 36 of the body 22. The body 22 defines the sound chamber 50, which has an opening 42 in the face portion 30. The sound chamber 50 comprises a central sound sub-chamber 50*b* and an outer sound sub-chamber 50*a*. In this embodiment, the central sound sub-chamber 50*b* has a larger volume than the outer sound sub-chamber 50*a*. The body 22 preferably has a volume ranging from 2.3 cubic inches to 2.8 cubic inches, and most preferably has a volume of 2.56 cubic inches. The sound chamber 50 preferably has a volume ranging from 0.5 cubic inch to 0.95 cubic inch, and most preferably 0.41 cubic inch. This embodiment of the putter-type golf club head 20 preferably has a pitch of 2400 Hz, an amplitude of 62.5 dBA and a duration of 45 milli-seconds.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf club head comprising:

a body comprising a heel end, a toe end, an aft end, a face portion, a crown portion and a sole portion, the body defining a sound chamber having an opening in the face portion, the sound chamber comprising a central sound sub-chamber and an outer sound sub-chamber; and a face insert positioned over the opening;

wherein the body, the sound chamber and the face insert amplify the sound generated by the golf club head striking a golf ball;

wherein when striking a golf ball, the golf club head has a pitch ranging from 2400 Hertz (Hz) to 2700 Hz;

wherein when striking a golf ball, the golf club head has an amplitude ranging from 61.5 to 64.5 dBA;

wherein when striking a golf ball, the golf club head has a duration ranging from 25 milliseconds to 45 milli-seconds.

2. The golf club head according to claim 1 wherein the sound chamber has a volume ranging from 0.25 cubic inch to 0.95 cubic inch.

3. The golf club head according to claim 1 wherein the body has a volume ranging from 2.3 cubic inches to 2.8 cubic inches.

4. The golf club head according to claim 1 wherein the body is composed of an iron alloy material.

5. The golf club head according to claim 1 wherein the face insert is composed of a metal material.

6. The golf club head according to claim 1 wherein the face insert has a variable face thickness.

7. The golf club head according to claim 1 wherein the face insert has a return portion and a striking plate portion.

8. The golf club head according to claim 1 wherein the face insert has a cross-bar pattern with a thick cross bar and a plurality of thin sections, wherein a thickness of the cross bar is at least 0.03 inch greater than a thickness of each of the plurality of thin sections.

9. The golf club head according to claim 1 wherein a volume of the central sound sub-chamber is greater than a volume of the outer sound sub-chamber.

10. A golf club head comprising:

a body defining a sound chamber having an opening in a face portion, the sound chamber; and a face insert positioned over the opening, the face insert having a cross-bar pattern with a thick cross bar and a plurality of thin sections, wherein a thickness of the cross bar is at least 0.03 inch greater than a thickness of each of the plurality of thin sections;

wherein the body, the sound chamber and the face insert amplify the sound generated by the golf club head striking a golf ball;

wherein when striking a golf ball, the golf club head has a pitch ranging from 2400 Hertz (Hz) to 2700 Hz;

wherein when striking a golf ball, the golf club head has an amplitude ranging from 61.5 to 64.5 dBA;

wherein when striking a golf ball, the golf club head has a duration ranging from 25 milliseconds to 45 milli-seconds.

11. The golf club head according to claim 10 wherein the face insert has a return portion and a striking plate portion.

12. The golf club head according to claim 10 wherein the sound chamber has a volume ranging from 0.25 cubic inch to 0.95 cubic inch.

13. The golf club head according to claim 10 wherein the body has a volume ranging from 2.3 cubic inches to 2.8 cubic inches.

14. The golf club head according to claim 10 wherein the body is composed of an iron alloy material.

15. The golf club head according to claim 10 wherein the face insert is composed of a metal material.

16. A golf club head comprising:

a body defining a sound chamber having an opening in a face portion, the sound chamber; and a face insert positioned over the opening, the face insert having a central section and a plurality of thin sections, wherein a thickness of the central section is at least 0.03 inch greater than a thickness of each of the plurality of thin sections;

wherein the body, the sound chamber and the face insert amplify the sound generated by the golf club head striking a golf ball;

wherein when striking a golf ball, the golf club head has a pitch ranging from 2400 Hertz (Hz) to 2700 Hz;

wherein when striking a golf ball, the golf club head has an amplitude ranging from 61.5 to 64.5 dBA;

wherein when striking a golf ball, the golf club head has a duration ranging from 25 milliseconds to 45 milliseconds.

17. The golf club head according to claim 16 wherein the face insert has a return portion and a striking plate portion.

18. The golf club head according to claim 16 wherein the sound chamber has a volume ranging from 0.25 cubic inch to 0.95 cubic inch.

19. The golf club head according to claim 16 wherein the body has a volume ranging from 2.3 cubic inches to 2.8 cubic inches.

* * * * *